US007721785B2

(12) United States Patent
Cooper et al.

(10) Patent No.: US 7,721,785 B2
(45) Date of Patent: May 25, 2010

(54) CONTINUOUSLY CASTING STEEL STRIP

(75) Inventors: W. Kent Cooper, Greencastle, IN (US); Steven R. Gage, Crawfordsville, IN (US)

(73) Assignee: Nucor Corporation, Charlotte, NC (US)

( * ) Notice: Subject to any disclaimer, the term of this patent is extended or adjusted under 35 U.S.C. 154(b) by 375 days.

(21) Appl. No.: 11/688,110

(22) Filed: Mar. 19, 2007

(65) Prior Publication Data

US 2007/0158046 A1 Jul. 12, 2007

Related U.S. Application Data

(63) Continuation of application No. 11/005,722, filed on Dec. 7, 2004, now Pat. No. 7,191,819.

(51) Int. Cl.
*B22D 11/06* (2006.01)

(52) U.S. Cl. ..... 164/428; 164/480

(58) Field of Classification Search ..... 164/428, 164/480

See application file for complete search history.

(56) References Cited

U.S. PATENT DOCUMENTS

| | | | |
|---|---|---|---|
| 5,184,668 | A | 2/1993 | Fukase et al. |
| 5,259,439 | A | 11/1993 | Blejde et al. |
| 5,277,243 | A | 1/1994 | Fukase et al. |
| 5,437,325 | A | 8/1995 | Legrand et al. |
| 5,688,425 | A | 11/1997 | Yamamoto et al. |
| 5,762,126 | A | 6/1998 | Assefpour-Dezfully et al. |
| 5,960,855 | A | 10/1999 | Assefpour-Dezfully et al. |
| 6,095,233 | A | 8/2000 | Leabeater et al. |
| 7,191,819 | B2 * | 3/2007 | Cooper et al. ..... 164/428 |

FOREIGN PATENT DOCUMENTS

| | | | |
|---|---|---|---|
| EP | 0 450 775 | A2 | 10/1991 |
| JP | 2004-42090 | A | 2/2004 |
| JP | 2004-042090 | A * | 2/2004 |
| WO | 97/27015 | A1 | 7/1997 |
| WO | 2004/007113 | A2 | 1/2004 |
| WO | 2005/044486 | A1 | 5/2005 |

OTHER PUBLICATIONS

Office Action CN200580047870.3, dated Jan. 1, 2009.
European Search Report for EP 05 80 4574.

* cited by examiner

*Primary Examiner*—Kevin P Kerns
(74) *Attorney, Agent, or Firm*—Hahn, Loeser & Parks, LLP; Arland T. Stein

(57) ABSTRACT

Thin cast strip is produced in a twin roll caster by delivering molten steel between the rolls to form a casting pool confined between the rolls by a pair of side dams adjacent the ends of the casting rolls. Steel strip is delivered downwardly to the nip through a metal delivery system having a tundish and core nozzles. One or more of the refractory components, including the tundish, core nozzles and side dams, or portions thereof, are replaced by first preheating the refractory component(s) being replaced at a removed location, and then rapidly transferring the preheated component(s) from the preheating position and installing the same in the operating position by a transfer device. The desired refractory component is rapidly removed and the preheated replacement refractory component rapidly transferred and installed in the operating position in an amount of time that avoids thermal shock to the refractories that are not replaced.

31 Claims, 6 Drawing Sheets

CONTINUOUSLY CASTING STEEL STRIP

This application is a continuation of co-pending application Ser. No. 11/005,722, now U.S. Pat. No. 7,191,819, the disclosure of which is hereby incorporated by reference.

BACKGROUND AND SUMMARY OF THE INVENTION

This invention relates to continuous casting of thin steel strip in a strip caster, particularly a twin roll caster.

In a twin roll caster, molten metal is introduced between a pair of contra-rotated horizontal casting rolls which are internally cooled so that metal shells solidify on the moving roll surfaces and are brought together at the nip between them to produce a thin cast strip product, delivered downwardly from the nip between the casting rolls. The term "nip" is used herein to refer to the general region at which the casting rolls are closest together.

The molten metal may be poured from a ladle through a metal delivery system comprised of a tundish and a core nozzle located above the nip, to form a casting pool of molten metal supported on the casting surfaces of the rolls above the nip and extending along the length of the nip. This casting pool is usually confined between refractory side plates or dams held in sliding engagement with the end surfaces of the rolls so as to dam the two ends of the casting pool against outflow.

When casting steel strip in a twin roll caster, the thin cast strip leaves the nip at very high temperatures, of the order of 1400° C. If exposed to normal atmosphere, it will suffer very rapid scaling due to oxidation at such high temperatures. A sealed enclosure is therefore provided beneath the casting rolls to receive the hot cast strip, and through which the strip passes away from the strip caster, which contains an atmosphere that inhibits oxidation of the strip. The oxidation inhibiting atmosphere may be created by injecting a non-oxidizing gas, for example, an inert gas such as argon or nitrogen, or combustion exhaust reducing gases. Alternatively, the enclosure may be sealed against ingress of an ambient oxygen-containing atmosphere during operation of the strip caster, and the oxygen content of the atmosphere within the enclosure reduced, during an initial phase of casting, by allowing oxidation of the strip to extract oxygen from the scaled enclosure as disclosed in U.S. Pat. Nos. 5,762,126 and 5,960,855.

The length of the casting campaign has been generally determined in the past by the wear cycle on the core nozzle, tundish and side dams. Multi-ladle sequences can be continued so long as the source of hot metal supplies ladles of molten steel, by use of a turret on which multiple ladles can be transferred to operating position. Therefore, the focus of attention in the casting campaign has been extending the life cycle of the core nozzle, tundish and side dams. When a nozzle, tundish or side dam would wear to the point that it had to be replaced, the casting campaign would have to be stopped, and the worn out component replaced. This would generally require removing unworn components as well since otherwise the length of the next campaign would be limited by the remaining useful life of the worn but not replaced refractory components, with attendant waste of useful life of refractories and increased cost of casting steel. Further, all of the refractory components, both replaced and continued components, would have to be preheated the same as starting the original casting campaign before the next casting could be done. Graphitized alumina, boron nitride and boron nitride-zirconia composites are examples of suitable refractory materials for this purpose. Since the core nozzle, tundish and side dams all have to be preheated to very high temperatures approaching that of the molten steel to withstand contact with the molten steel over long periods, considerable waste of casting time between campaigns resulted. See U.S. Pat. Nos. 5,184,668 and 5,277,243.

The disclosed apparatus and method limits down time in changes of worn refractory components, decreases waste of useful life of refractory components, reduces energy needs in casting, and increases casting capacity of the caster. Useful life of refractories can be increased, and reheating of unreplaced refractory components can be avoided or minimized. The core nozzle must be put in place before the tundish, and conversely the tundish must be removed before core nozzle can be replaced, and both of these refractory components wear independently of each other. Similarly, the side dams wear independently of the core nozzles and tundish, and independently of each other, because the side dams must initially be urged against the ends of the casting rolls under applied forces, and "bedded in" by wear so as to ensure adequate sealing against outflow of molten steel from the casting pool. The forces applied to the side dams may be reduced after an initial bedding-in period, but will always be such that there is significant wear of the side dams throughout the casting operation. For this reason, the core nozzle and tundish in the metal delivery system can have a longer life than the side dams, and can normally continue to be operated through several more ladles of molten steel supplied in a campaign. Nevertheless, the duration of a casting campaign is often determined by the rate of wear of the side dams because tundish and core nozzle, which still have useful life, are often changed when the side dams are changed to increase casting capacity of the caster. No matter which refractory component wears out first, a casting run will need to be terminated to replace the worn out component. Since the cost of thin cast strip production is directly related to the length of the casting time, unworn components in the metal delivery system are generally replaced before the end of their useful life as a precaution to avoid further disruption of the next casting campaign, with attendant waste of useful life of refractory components.

By the disclosed apparatus and method, it is possible to replace in a minimal period of time anyone or more of the refractory components, for example, the core nozzle, tundish and/or side dams, without replacing any of the other refractory components, to avoid the need for reheating the unreplaced refractory components, and in turn, to extend casting campaign lengths, reduce waste of refractory components, and reduce operating costs and increase casting time.

The second tundish and/or second side dam or dams, or portions thereof, are generally preheated and replaced as singular refractory components, and the core nozzle is generally preheated and replaced as a singular or two part refractory component, but in particular embodiments these refractory components may be preheated and replaced in parts or pieces as desired. In any event, the refractory component or portion thereof may be preheated to a temperature near the temperature of molten steel in the casting pool. Typically, the preheat temperature is greater than about 1200° C. The preheating of rapidly transferring of the second core nozzle may be done for at least about 2 hours before transfer to the operating position, the preheating of rapidly transferring of the second tundish may be done for at least about 2 hours before transfer to the operating position, and the preheating of rapidly transferring of the second side dams may be done for at least about 0.5 hours before transfer to the operating position. If only a portion of one of these refractory components is to be replaced, the preheating of that portion of the component will normally be done for the same time period as for the preheating of the entire refractory component unless that portion is such that it can be preheated to the desired preheat temperature in less time. The preheat temperature is also normally the same if more than one core nozzle, one tundish or two side dams is used in the particular embodiment.

An apparatus for producing thin cast strip by continuous casting may be comprised of:

a) a pair of casting rolls having a nip therebetween;

b) a metal delivery system comprising a first core nozzle and a first tundish for delivering molten metal into a casting pool between the casting rolls above the nip, and first side dams adjacent the ends of the nip to confine said casting pool;

c) a casting roll drive capable of counter-rotating the casting rolls to form solidified metal shells on casting surfaces of the casting rolls and to cast solidified thin steel strip through the nip between the casting rolls from said solidified shells;

d) a plurality of preheating chambers removed from an operating position for casting capable of preheating at least a portion of at least one refractory component selected from the group consisting of a second core nozzle, a second tundish and at least one second side dam to a temperature to avoid thermal shock when contacted by molten steel while casting continues;

e) a gate capable of interrupting the flow of molten metal to the casting pool, and capable of resuming flow of molten steel to reform the casting pool;

f) a first transfer device capable of removing from an operating position at least portions of at least one component selected from the group consisting of at least a portion of the first core nozzle, the first tundish and at least one of said first side dams desired to be replaced while leaving other components in an operating position; and g) a second transfer device capable of rapidly transferring at least portions of at least one preheated component selected from the group consisting of the second core nozzle, the second tundish and at least one second side dam for replacement from the preheating chamber to the operating position for casting while leaving other components in an operating position.

Again, in the apparatus, the second tundish and/or second side dam or dams, or portions thereof, are generally preheated and replaced as singular refractory components, and the core nozzle is generally preheated and replaced as a singular or two part refractory component, but in particular embodiments these refractory components may be preheated and replaced in parts or pieces as desired. In any event, at least one component from the group consisting of the second core nozzle, the second tundish or the second side dams may be preheated to a temperature near the temperature of molten steel in the casting pool. Again, typically the component or components, or portion thereof, to be replaced is/are preheated to 1200° C. The preheating of the second core nozzle may be done for at least about 2 hours before transfer to the operating position, the preheating of rapidly transferring of the second tundish may be done for at least about 2 hours before transfer to the operating position, and the preheating of rapidly transferring of the second side dams may be done for at least about 0.5 hours before transfer to the operating position. Again, if only a portion of one of these refractory components is to be replaced, the preheating of that portion of the refractory component will normally be done for the same time period as for the preheating of the entire refractory component unless that portion is such that it can be preheated to the desired preheat temperature in less time. The preheat temperature is also normally the same if more than one core nozzle, one tundish or two side dams is used in the particular embodiment.

The apparatus may further comprise a sensor, such as an optical sensor or an electrical sensor, to monitor the wear of the first core nozzle, the first tundish and/or the first side dams. The method may further comprise the step of monitoring the wear of at least a portion of one refractory component from the group consisting of the first core nozzle, the first tundish and the first side dams. The first core nozzle, first tundish or first side dams may be removed one at a time, or in pieces, when the sensor reveals that the refractory component is worn to a specified limit. Note again that when a refractory component is replaced in parts as worn, a separate sensor will normally be provided for each piece of the refractory component to be replaced as worn.

The apparatus may also be automated by including in addition a control system, typically including a computerized circuit, so that, when a given level of wear is detected by the sensor(s) in a particular worn first core nozzle, first tundish and/or first side dames), or portion thereof, the worn refractory component or portion thereof is automatically replaced. Note that when a refractory component is replaced in parts as worn, a separate sensor will normally be provided for each portion of the refractory component to be replaced as worn.

Alternatively, the apparatus may have a preheating chamber or chambers removed from an operating position for casting thin cast strip capable of preheating one or both of the second side dams, or portions thereof, to a temperature to avoid thermal shock when contacted by molten steel. In this embodiment, the core nozzle or the tundish, or both, (or a part thereof) may be replaced independently of the side dams. It should be noted that the apparatus can be embodied if more than two side dams are desired to be utilized in a particular embodiment.

The molten steel may be introduced between the casting rolls through a metal delivery system comprising a tundish and a core nozzle, in one or more pieces, disposed above the nip, and the interruption of the flow of molten steel to the casting pool may be achieved by interrupting flow to the metal delivery system by closing the slide gate. The preheating of the replacement side dams in the preheat chamber(s) is initiated while continuing casting of the strip. The wear of the side dams may be monitored by a sensor or sensors, and the removal and replacement of the side dams may be accomplished when the sensor indicates that the dams or portion thereof is (are) worn to specified limits.

In order to ensure the components in the metal delivery system do not suffer thermal shock on resumption of casting and also to ensure that steel does not solidify within the flow passages of the metal delivery system, it is desirable that the time interval between interrupting and resuming the flow of molten steel in either the method or the apparatus be less than about 15 minutes. The change time will depend on the number and nature of the component or components being replaced, and typically will be less than about 5 minutes.

More specifically, the replacement of the replacement one or more side dams, tundish and/or core nozzles, or portions thereof, may be carried out so that this time interval is about 5 minutes or less, or about 2 minutes or less.

It should be noted that the tundish here that is replaced is a replaceable tundish above the core nozzle, and may be sometimes called the transition piece or delivery vessel.

There may be another tundish above the replaceable tundish, which is also part of the metal delivery system that is not replaced in the disclosed method and apparatus as discussed below.

BRIEF DESCRIPTION OF THE DRAWINGS

The operation of an illustrative twin roll installation in accordance with the disclosed method and apparatus will now be described with reference to the accompanying drawings in which.

DETAILED DESCRIPTION OF THE DRAWINGS

Figure 1:
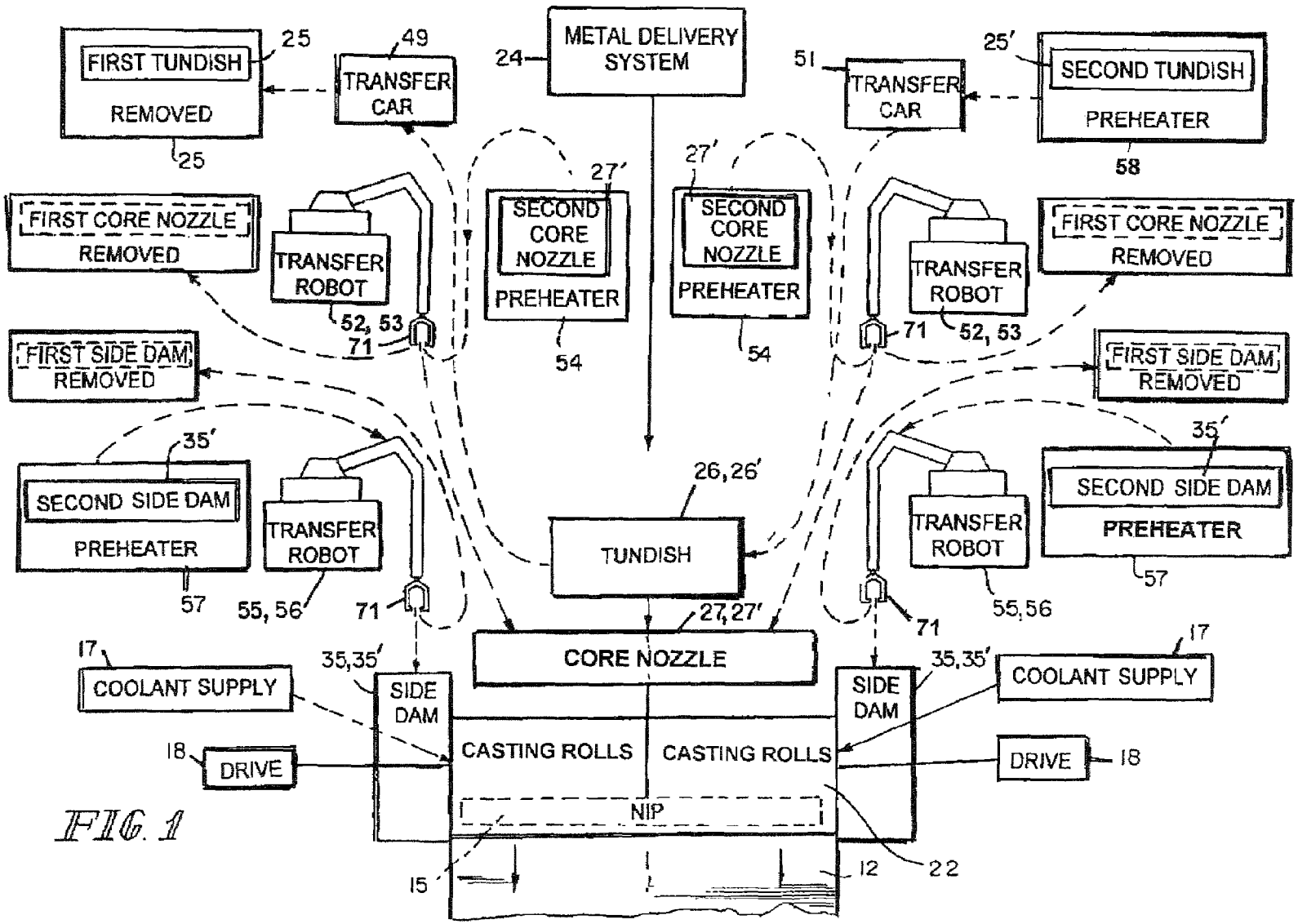
FIG. 1 is a schematic illustrating the operation of the disclosed method and apparatus.

The illustrative twin roll caster comprises a twin roll caster denoted generally as 11 producing a cast steel strip 12 which passes within a sealed enclosure 10 to a guide table 13, which guides the strip to a pinch roll stand 14 through which it exits the sealed enclosure 10. The seal of the enclosure 10 may not be complete, but appropriate to allow control of the atmosphere within the enclosure and access of oxygen to the cast strip within the enclosure as hereinafter described. After exiting the sealed enclosure 10, the strip may pass through other sealed enclosures and may be subjected to in-line hot rolling and cooling treatment forming no part of the claimed invention.

Twin roll caster 11 comprises a pair of laterally positioned casting rolls 22 forming a nip 15 therebetween, to which molten metal from a ladle 23 is delivered through a metal delivery system 24. Metal delivery system 24 comprises a tundish 25, a removable tundish 26 and one or more core nozzles 27 which are located above the nip 15. The molten metal delivered to the casting rolls is supported in a casting pool 16 on the casting surfaces of the casting rolls 22 above the nip 15.

The casting pool of molten steel supported on the casting rolls is confined at the ends of the casting rolls 22 by a pair of first side dams 35, which are applied to stepped ends of the rolls by operation of a pair of hydraulic cylinder units 36 acting through thrust rods 50 connected to side plate holders 37.

The casting rolls 22 are internally water cooled by coolant supply 17 and driven in counter rotational direction by drives 18, so that metal shells solidify on the moving casting roll surfaces as the casting surfaces move through the casting pool 16. These metal shells are brought together at the nip 15 to produce the thin cast strip 12, which is delivered downwardly from the nip 15 between the rolls.

Tundish 25 is fitted with a lid 28. Molten steel is introduced into the tundish 25 from ladle 23 via an outlet nozzle 29. The tundish 25 is fitted with a stopper rod 33 and a slide gate valve 34 to selectively open and close the outlet 31 and effectively control the flow of metal from the tundish to the removable tundish 261. The molten metal flows from tundish 25 through the outlet 31 through an outlet nozzle 32 to removable tundish 26, (also called the distributor vessel or transition piece), and then to core nozzles 27. At the start of a casting operation a short length of imperfect strip is produced as the casting conditions stabilize.

Figure 2:
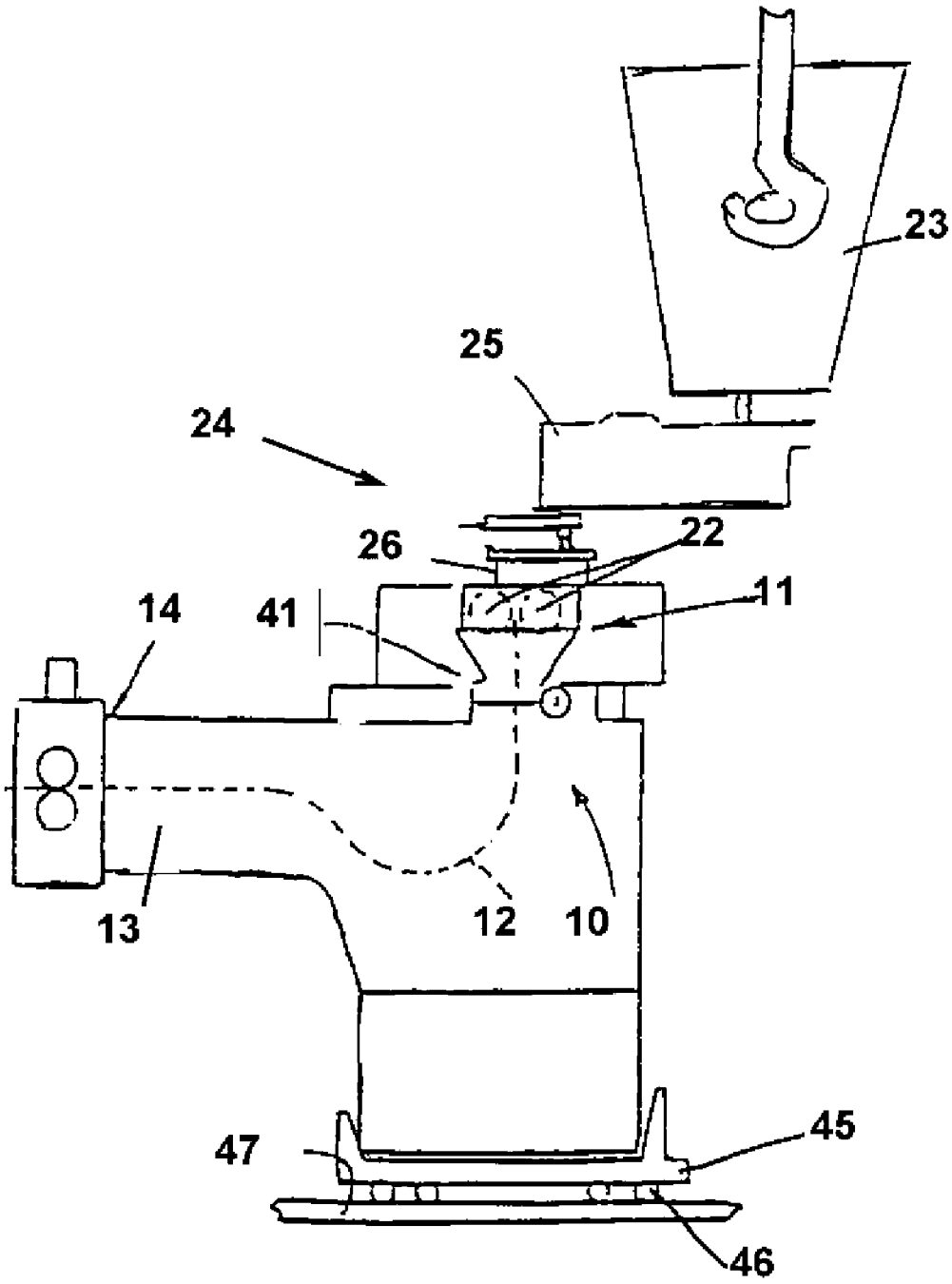
FIG. 2 is a vertical cross-section through an illustrative twin roll strip caster installation operable in accordance with the system shown in FIG. 1.
Figure 3:
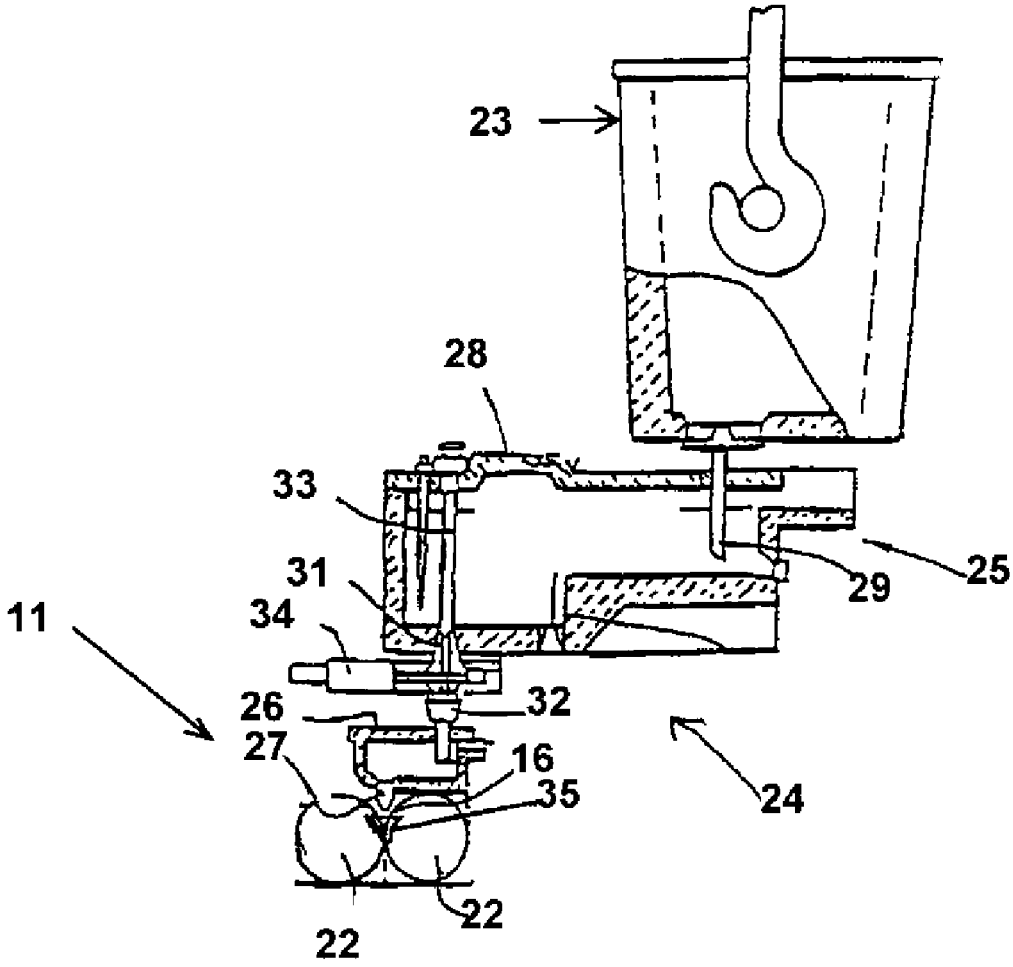
FIG. 3 illustrates a metal delivery system for the caster.
Figure 4:
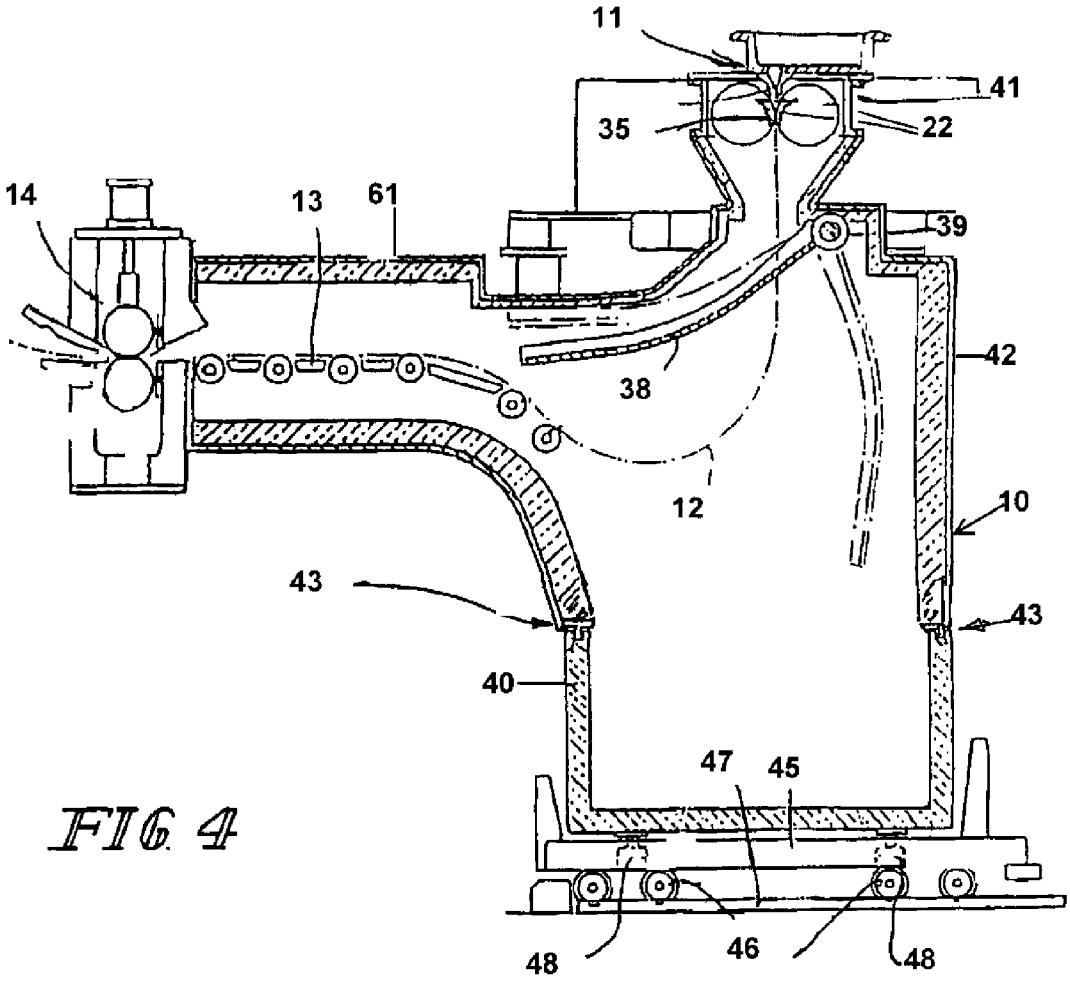
FIG. 4 is an enlarged view depicting an illustrative caster sealed enclosure to receive the cast strip.
Figure 5:
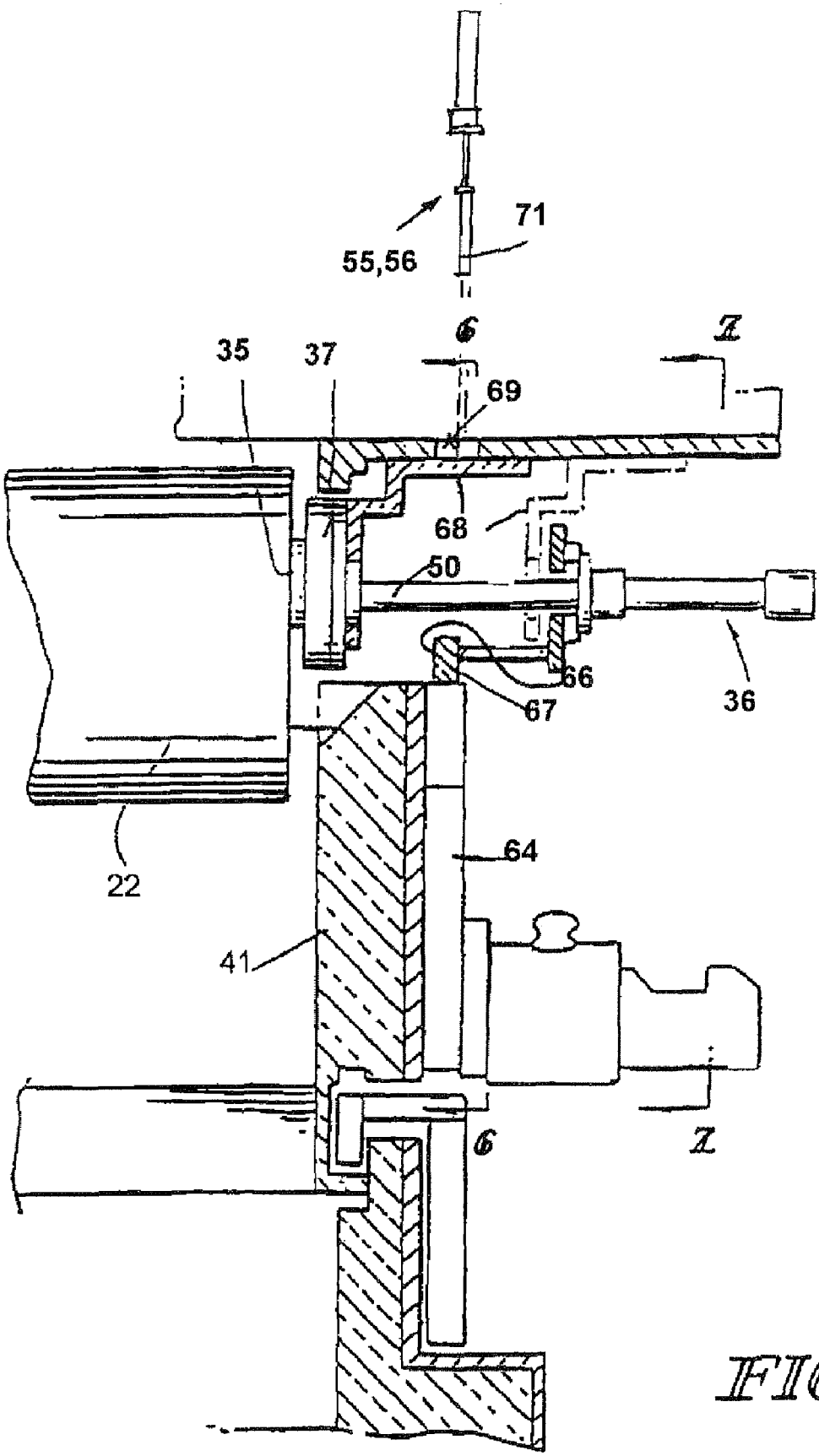
FIG. 5 is an enlarged vertical cross-section through an end part of the twin roll caster.
Figure 6:
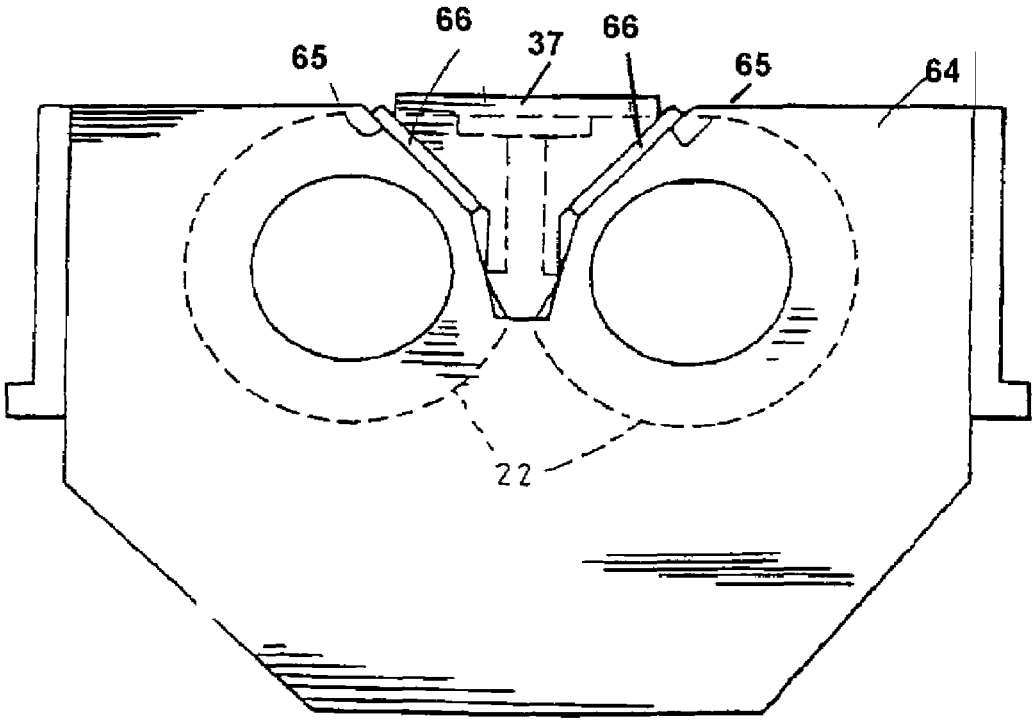
FIG. 6 is a cross-section taken generally along the line 6-6 in FIG. 5.
Figure 7:
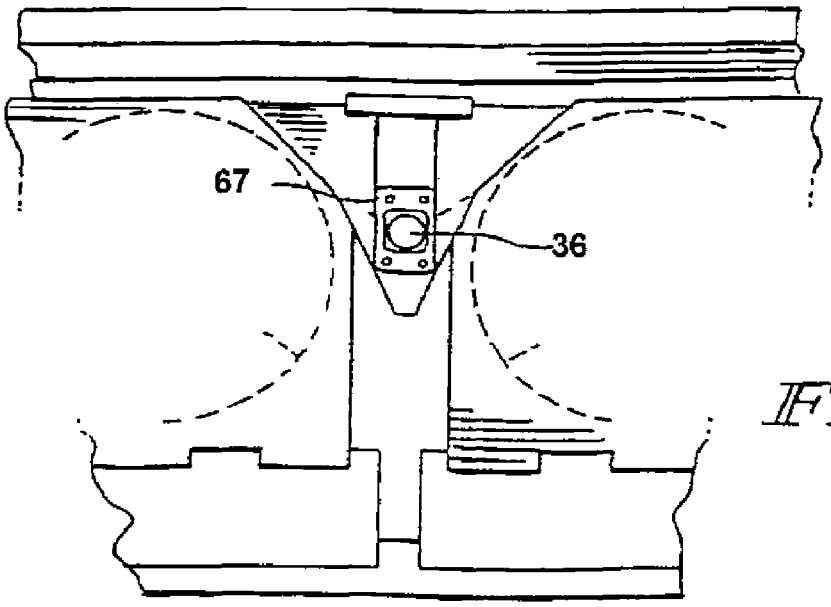
FIG. 7 is a cross-section taken generally along the line 7-7 in FIG. 5.

After continuous casting is established, the casting rolls are moved apart slightly and then brought together again to cause this leading end of the strip to break away so as to form a clean head end of the following cast strip to start the casting campaign. The imperfect material drops into a scrap box receptacle 40 located beneath caster 11 and forming part of the enclosure 10 as described below. At this time, swinging apron 38, which normally hangs downwardly from a pivot 39 to one side in enclosure 10, is swung across the strip outlet from the nip 15 to guide the head end of the cast strip onto guide table 13, which feeds the strip to the pinch roll stand 14. Apron 38 is then retracted back to its hanging position to allow the strip to hang in a loop beneath the caster, as shown in FIGS. 2 and 4, before the strip passes to the guide table 13 where it engages a succession of guide rollers.

The twin roll caster illustratively may be of the kind which is illustrated in some detail in U.S. Pat. Nos. 5,184,668 and 5,277,243, and reference may be made to those patents for appropriate constructional details which form no part of the claimed invention.

Enclosure 10 is formed by a number of separate wall sections which fit together at various seal connections to form a continuous enclosure wall. These comprise a first wall section 41 which is formed at twin roll caster 11 to enclose casting rolls 22, and a wall enclosure 42 which extends downwardly beneath first wall section 41, to form an opening which is closed by sealing engagement with the upper edges of a scrap box receptacle 40 as described below.

A seal 43 between the scrap box receptacle 40 and the enclosure wall 42 may be formed by a knife and sand seal around the opening in the enclosure wall, which can be established and broken by vertical movement of scrap box receptacle 40 relative to the enclosure wall 42. More particularly, the upper edge of the scrap box receptacle may be formed with an upwardly facing channel which is filled with sand and which receives a knife flange depending downwardly around the opening on the enclosure wall. A seal is formed by raising the scrap box receptacle to cause the knife flange to penetrate the sand in the channel to establish the seal 43 This seal can be broken by lowering the scrap box receptacle 40 from its operative position preparatory to movement away from the caster to a scrap discharge position (not shown).

Scrap box receptacle 40 is mounted on a carriage 45 fitted with wheels 46, which run on rails 47, whereby the scrap box receptacle can be moved to the scrap discharge position. Carriage 45 is fitted with a set of powered screw jacks 48 operable to lift the scrap box receptacle 40 from a lowered position, in which it is spaced from the enclosure wall 42, to a raised position where the knife flange penetrates the sand to form seal 43 between the two.

Sealed enclosure 10 further may have a third wall section 61 disposed about guide table 13 The third wall section 61 is also connected to the frame of pinch roll stand 14, which includes a pair of pinch rolls 62, against which the enclosure 10 is sealed by sliding seals 63.

Most of the enclosure wall sections 41 and 61, together with wall enclosure 42, may be lined with fire brick. Scrap box receptacle 40 may be lined either with fire brick or with a castable refractory lining.

The first enclosure wall section 41 surrounds the casting rolls 22 and is formed with side plates 64 provided with notches 65 shaped to snugly receive the side dam plate holders 37 when the pair of side dams 35 are pressed against the ends of casting rolls 22 by the cylinder units 36. The interfaces between the side plate holders 37 and the enclosure side wall sections 41 are sealed by sliding seals 66 to maintain sealing of the enclosure 10. Seals 66 may be formed of ceramic fiber rope or other suitable sealing material.

The cylinder units 36 extend outwardly through the enclosure wall section 41, and at these locations the enclosure is sealed by sealing plates 67 fitted to the cylinder units so as to engage with the enclosure wall section 41 when the cylinder units are actuated to press the pool closure plates against the ends of the casting rolls. Cylinder units 36 also move refractory slides 68 which are moved by the actuation of the cylinder units to close slots 69 in the top of the enclosure, through which the side dams 35 are initially inserted into the enclosure 10 and into the holders 37 for application to the casting rolls. The top of the sealed enclosure 10 is closed by the tundish 26, the side plate holders 37 and the slides 68 when the cylinder units are actuated to urge the side dams 35 against the casting rolls 22. In this way, the complete enclosure 10 is sealed prior to a casting operation, thereby limiting the supply of oxygen to the strip 12 as it passes from casting rolls 22 to the pinch roll stand 14. Initially the strip may take up all of the oxygen from enclosure 10 space to form heavy scale on the strip.

However, the sealing of space of enclosure 10 limits the ingress of oxygen containing atmosphere below the amount of oxygen that could be taken up by the strip. Thus, after an initial start-up period, the oxygen content in the enclosure 10 will remain depleted so limiting the availability of oxygen for oxidation of the strip 12. In this way, the formation of scale is controlled without the need to continuously feed a reducing or non-oxidizing gas into the enclosure 10.

Of course, a reducing or non-oxidizing gas may be fed into the enclosure 10.

However, in order to avoid the heavy scaling during the start-up period, the enclosure can be purged immediately prior to the commencement of casting, so as to reduce the initial oxygen level within the enclosure 10. In this way, the time is reduced that is needed to stabilized the oxygen level as a result of the interaction of oxygen in the sealed enclosure due to oxidation of strip 12 passing through it. Thus, illustratively, the enclosure 10 may conveniently be purged with, for example, nitrogen gas. It has been found that reduction of the initial oxygen content to levels of between 5% to 10% will limit the scaling of the strip at the exit from the enclosure 10 to about 10 microns to 17 microns even during the initial start-up phase.

When it is determined that a change has to be made in the side dams 35, core nozzle 27 of removable tundish 26 due to wear or any another reason, preheating is commenced of a second refractory component identified to be in need of replacement. This preheating of the second tundish 26' or second core nozzle 27' is started while casting is continuing at least 2 hours before transfer to the operating position, and the preheating of the second side dams 35' is started at least 0.5 hours before transfer to the operating position.

This preheating is done in a preheating heater 58 54 or 57, typically a preheating chamber, in a location convenient to the caster 11, but removed from the operating position of the refractory components during casting.

During this preheating of the replacement refractory component, casting typically continues without interruption. When the refractory component is ready to be replaced, namely, the tundish 26, the core nozzle 27 or the side dams 35, the slide gate 34 is closed and the tundish 26, the core nozzle 27 and the casting pool 16 are drained of molten metal.

Typically, the tundish 26', and side dam 35' are preheated and replaced as singular refractory components, and the core nozzle 27' is preheated and replaced as a singular or two piece refractory component, but in particular embodiments may be preheated and replaced in pieces or parts as those portions of the refractory component are worn If the first tundish 26 is to be replaced, typically transfer car 49 comes in and removes the tundish 26 from the operating position, and then the second tundish 26' is taken from a preheating chamber 58 to the operating position by transfer car 51. The details of the transfer cars 49 and 51 are not shown since they are essentially fork lifts on rails that move from the preheating position to the operating position, with hydraulic lifts to raise and lower the tundish into either the preheating position or the operating position. Note that transfer cars 49 and 51 may be the same transfer car if there is a place for the car transfer to rapidly set the removed first tundish 26 as shown in FIG. 1; however, to save time in removing the first tundish 26 and positioning the second tundish 26' in the operating position, two transfer cars 49 and 51 may be employed. Following positioning of the second tundish 26' in the operating position, the gate 34 is opened to fill the tundish 26' and core nozzles 27 and continue the casting operation by fining the tundish 26 and core nozzle 27 and forming casting pool 16 with molten metal.

If the first core nozzles 27, typically in two parts, are to be replaced, transfer car 49 comes in and removes the first tundish 26 from the operating position, and then a pair of transfer robots 52 take the first core nozzle 27 from the operating position, and a pair of transfer robots 53 transfer the second core nozzle 27', again typically in two parts, from preheating chambers 54 to the operating position. Note that the core nozzle 27 may be in one or two pieces, or multiple pieces, and may be replaced in whole or in pieces as worn to specified limits, depending on the particular embodiment of the metal delivery system. Note also that transfer robots 52 and 53 may be the same as shown in FIG. 1 if there is a place for the robots to rapidly set down the removed first core nozzle 27; however, to save time in removing the first core nozzle 27 and positioning the second core nozzle 27' in the operating position, separate transfer robots 52 and 53, typically in pairs, may be employed. Following positioning of the second core nozzle 27' in the operating position, transfer car 49 then repositions the tundish 26 in the operating position and the slide gate 34 is opened to fill the tundish 26 and core nozzle 27' and continue the casting campaign by filling the tundish 26, core nozzle 27' and casting pool 16 with molten metal. Note that if desired, core nozzle 27' and removable tundish 26' may be replaced at the same time, as described in more detail below.

When it is determined that a change has to be made in the side dams 35 due to wear or any another reason, preheating is begun of one or more second side dams 35' identified to be in need of replacement as casting continues. This preheating of the second side dams 35' is started at least 0.5 hours before transfer to the operating position. During this preheating of the replacement refractory component, casting is typically continued without interruption. When the preheating is completed and the change in side dams is to take place, the slide gate 34 is closed and the tundish 26, core nozzle 27 and casting pool 16 are drained and the casting is interrupted. A pair of transfer robots 55 remove the first side dams 35 from the operating position, and then a pair of transfer robots 56 transfer the second side dams 35' from the preheating chamber 57 to the operating position. Note that transfer robots 55 and 56 may be the same as shown in FIG. 1 if there is a place for the transfer robots to rapidly set aside the removed first side dams 35; however, to save time in removing the side dams 35 and positioning the second side dams 35' in the operating position, two pairs of transfer robots 55 and 56 may be employed. Following positioning of the second side dams 35' in the operating position, the slide gate 34 is opened to fill the tundish 26 and core nozzle 27 and form casting pool 16, and continue casting. Note that transfer robots 55 and 56 may be the same transfer robots 52 and 53, used to transfer the core nozzles, fitted with a second set gripper arms 71.

In each case, there is a premium on the speed with which the transfer of the tundish, core nozzles and/or side dams is completed to minimize the interruption of the casting operation. The transfer is completed within 15 minutes and typically within 5 minutes or even 2 minutes to avoid thermal shock to the refractories.

Each transfer robot 52, 53, 55 and 56 is a robot device known to those skilled in the art with gripping arms 71 to grip the core nozzle 27 or 27' typically in two parts, or side dams 35 or 35'. They can be raised and lowered and also moved horizontally along overhead tracks to move the core nozzle 27' or the side dams 35' from a preheating chamber 54 or 57 at a separate location from the operating position to the caster for downward insertion of the plates through the slots 69 into the holders 37. Gripper arms 71 are also operable to remove at least portions of worn core nozzle 27 or side dams 35. The step of removing the worn side dam 35 is done by operating cylinder unit 36 to withdraw the thrust rod sufficiently to open the slot 69 and to bring side dam 35 into position directly beneath that slot, after which the gripping arm 71 of the transfer robot 55 can be lowered through the slot to grip the side dam 35 and then raised to withdraw the worn side dam. The side dams 35 may be removed when they become worn to specified limits as will be explained further below, and may be removed one at a time as worn to a specified limit. During a casting run and at a time interval before the side dams 35 have worn down to an unserviceable level, the wear rate of the side dams 35 may be monitored by sensors, and the preheating of replacement side dams 35' is commenced in preheat furnaces at preheating chamber 57 separate from the caster 11. This time interval may be of at least about 0.5 hours for normal preheating in conventional preheat furnaces, although longer preheat times may be necessary and accommodated according to the particular equipment used. If only a portion of core nozzle 27 or the side dams 35 are/is to be replaced, the preheating of that portion of the refractory component will normally be done for the same time period as for the preheating of the entire refractory component unless that portion is such that it can be preheated to the desired preheat temperature in less time.

In each case, when the replacement tundish 26', core nozzles 27' or side dams 35' have been preheated to service temperatures approaching the temperature of the molten metal, the procedure is initiated for replacement of that refractory component. To avoid thermal stock, generally the preheating should be to at least 1200° C. The caster operator actuates slide gate 34 to interrupt casting by interrupting the flow of molten steel to removable tundish 26 (also called a delivery vessel or transition piece) while allowing casting to proceed to drain molten steel from tundish 26, core nozzle 27 and casting pool 16.

To change the side dams 35, when the molten steel has drained from the metal delivery system and casting pool, cylinder units 36 are operated to retract the side plate holders 37 and to bring the side dams 35 directly beneath the slots 69 which are opened by the retraction movement of the slides 68. Transfer robots 55 may then be lowered such that their gripping arms 71 can grip the side dams 35 and raised and remove those worn side dams, which can then be dumped for scrap or refurbishment. The transfer robots 56 are then moved to the preheat chambers where they pick up the replacement side dams 35' and move them into position above the slots 69 and the retracted side plate holders 37. Side dams 35' are then lowered by the transfer robots 56 into the plate holders, the transfer robots 56 are raised and the cylinder units 36 operated to urge the preheated replacement side dams 35' against the end of the casting rolls 22 and to move the slides 68 to close the enclosure slots 69. The operator then actuates slide gate 34 to initiate resumption of casting by pouring molten steel into tundish 26 and core nozzle 27, to initiate a normal casting operation in a minimum of time.

The tundish 26, core nozzle 27 or side dams 35 at any desired time may be replaced as described herein. The core nozzle 27 may be replaced as a singular refractory component or in parts. The side dams 35 may be replaced one at a time, in pairs or in a plurality of parts. The illustrated apparatus and the above described method has made it possible for tundish, core nozzle and/or side dam replacement to be carried out in less than about 15 minutes, and typically in 5 minutes or less, or 2 minutes or less. The other refractory components, which are not replaced, can continue to be used in the caster without reheating.

It has been found that refractory components that remain in the casting system retain sufficient heat to avoid thermal shock on resumption of casting and to ensure that steel does not solidify within the flow passages of the metal delivery system if the replacement is done in the way described.

It may be desirable to replace a side dam or dams 35 when worn to specified limits, such as when the dams become or will become unserviceable. For example, the wear of the side dams may be monitored by means of load/displacement transducers mounted on cylinders 36. The cylinders will generally be operated so as to impose a relatively high-force on the side dams 35 during an initial bedding-in period in which there will be a higher wear rate after which, the force may be reduced to a normal operating force. The output of the displacement transducers on cylinders 36 can then be analyzed by a control system, usually including a computerized circuit, to establish a progressive wear rate and to estimate a time at which the wear will reach a level at which the side plates become unserviceable.

The control system is responsive to the sensors to determine the time at which preheating of replacement side darns must be initiated prior to interrupting the cast for replacement of the side dams.

Wear of tundish 26 and core nozzles 27 also can be monitored by sensors positioned sense the areas of these refractories components most likely to wear first. In this way, the entire apparatus can be automated so that the change of the side dams, core nozzles and tundish is done automatically by the control system (not shown) which monitors the sensors on the side dams, core nozzles and tundish, and automatically initiate the preheating and subsequent change out of the refractory components identified that is in need of placement. If the refractory components are to be replaced in pieces as wear is detected, a sensor will typically be positioned at the place most likely to wear of each portion of the refractory component to be replaced.

Although the invention has been illustrated and described in detail in the foregoing drawings and description with reference to several embodiments, it should be understood that the description is illustrative and not restrictive in character, and that the invention is not limited to the disclosed embodiments. Rather, the present invention covers all variations, modifications and equivalent structures that come within the scope and spirit of the invention. Additional features of the invention will become apparent to those skilled in the art upon consideration of the detailed description, which exemplifies the best mode of carrying out the invention as presently perceived. Many modifications may be made to the present invention as described above without departing from the spirit and scope of the invention.

What is claimed is:

1. An apparatus for producing thin cast strip by continuous casting comprising:

a) a pair of casting rolls having a nip therebetween;

b) a metal delivery system comprising a first core nozzle and a first tundish for delivering molten metal into a casting pool between the casting rolls above the nip, and first side dams adjacent the ends of the nip to confine said casting pool;

c) a casting roll drive capable of counter-rotating the casting rolls to form solidified metal shells on casting surfaces of the casting rolls and to cast solidified thin steel strip through the nip between the casting rolls from said solidified shells;

d) a plurality of preheating chambers removed from an operating position for casting, each capable of preheating at least a portion of at least one refractory component selected from the group consisting of a second core nozzle, a second tundish and at least one second side dam to a temperature to avoid thermal shock when contacted by molten steel while casting continues;

e) a gate capable of interrupting the flow of molten metal to the casting pool, and capable of resuming flow of molten steel to reform the casting pool;

f) a first transfer device capable of removing from an operating position at least portions of at least one component selected from the group consisting of at least a portion of the first core nozzle, the first tundish and at least one of said first side dams desired to be replaced while leaving other components in an operating position; and g) a second transfer device capable of transferring at least portions of at least one preheated refractory component selected from the group consisting of the second core nozzle, the second tundish and said at least one second side dam for replacement from the preheating chamber to the operating position for casting while leaving other components in an operating position.

2. The apparatus of claim 1 wherein that the preheated portion of the at least one refractory component selected from the group consisting of the second core nozzle, the second tundish and said at least one second side dam is preheated to a temperature near the temperature of molten steel in the casting pool.

3. The apparatus of claim 1 wherein the second transfer device is capable of transferring at least a portion of at least one preheated refractory component selected from the group consisting of the second core nozzle, second tundish and at least one second side dam rapidly from the preheating position and installing as a replacement in the operating position for casting within about 15 minutes.

4. The apparatus of claim 1 wherein the second transfer device is capable of transferring at least a portion of at least one preheated refractory component selected from the group consisting of the second core nozzle, second tundish and at least one second side dam rapidly from the preheating position and installing as a replacement in the operating position for casting within about 5 minutes.

5. The apparatus of claim 1 further comprising a sensor to monitor the wear of at least a portion of the first core nozzle, the first tundish and the first side dams.

6. The apparatus of claim 5 wherein the sensor comprises an optical sensor.

7. The apparatus of claim 5 wherein the sensor comprises an electrical sensor.

8. The apparatus of claim 1 further comprising a transfer device to remove at least a portion of one component selected from the group consisting of the first tundish, the first core nozzle or at least one of the first side dams when a sensor reveals the same is worn to specified limits.

9. The apparatus of claim 8 further comprising in addition a control system responsive to a sensor detecting a given level of wear on at least a portion of at least one refractory component selected from the group consisting of the first core nozzle, the first tundish and at least one of the first side dams, and automatically replacing the same.

10. The apparatus of claim 5 wherein the preheating of the at least a portion of second core nozzle is started at least about 2 hours before transfer to the operating position, the preheating of the at least a portion of the second tundish is started at least about 2 hours before transfer to the operating position, and the preheating of the at least a portion of the second side dam or dams is started at least about 0.5 hours before transfer to the operating position.

11. The apparatus of claim 1 wherein the first transfer device is capable of horizontal translation.

12. An apparatus for producing thin cast strip by continuous casting comprising:

a) a pair of casting rolls having a nip therebetween;

b) a metal delivery system comprising a first core nozzle and a first tundish for delivering molten metal into a casting pool between the casting rolls above the nip, and first side dams adjacent the ends of the nip to confine said casting pool;

c) a casting roll drive to counter-rotate the casting rolls to form solidified metal shells on casting surfaces of the casting rolls and cast thin steel strip through the nip between the casting rolls from said solidified shells;

d) two preheating chambers removed from an operating position for casting, each capable of preheating at least a portion of at least one second side dam to a temperature to avoid thermal shock when contacted by molten steel while casting continues;

e) a gate capable of interrupting the flow of molten metal to the casting pool, and capable of resuming flow of molten steel to reform the casting pool;

f) a first transfer device capable of rapidly removing from an operating position at least portions of at least one of said first side dams desired to be replaced while leaving other components in an operating position; and g) a second transfer device capable of rapidly transferring at least portions of at least one second side dam for replacement from the preheating chamber to the operating position for casting while leaving other components in an operating position.

13. The apparatus of claim 12 wherein that the preheated portion of at least one of the second side dam is preheated to a temperature near the temperature of molten steel in the casting pool.

14. The apparatus of claim 12 wherein the second transfer device is capable of transferring at least preheated portions of the at least one second dam from the preheating position and installing as a replacement in the operating position for casting within about 15 minutes.

15. The apparatus of claim 12 wherein the second transfer device is capable of transferring at least preheated portions of the at least one second side dam from the preheating position and installing as a replacement in the operating position for casting within about 5 minutes.

16. The apparatus of claim 12 further comprising a sensor to monitor the wear of at least portions of the first side dams.

17. The apparatus of claim 16 wherein the sensor comprises an optical sensor.

18. The apparatus of claim 16 wherein the sensor comprises an electrical sensor.

19. The apparatus of claim 12 further comprising a sensor capable of sensing that at least a portion of the side dam is worn to specified limits, and a transfer device capable of removing at least a portion of the worn side dam when a sensor reveals the specified limits are reached.

20. The apparatus of claim 19 further comprising in addition a control system responsive to a sensor detecting a given level of wear on at least a portion of the first side dam and automatically replacing the first side dam with a second side dam.

21. The apparatus of claim 12 wherein the preheating of at least a portion of the at least one second side dam is started at least about 0.5 hours before transfer to the operating position for casting.

22. An apparatus of producing thin cast strip by continuous casting comprising:

a) a pair of casting rolls having a nip therebetween;

b) a metal delivery system comprising a first core nozzle and a first tundish for delivering molten metal into a casting pool between the casting rolls above the nip, and first side dams adjacent the ends of the nip to confine said casting pool;

c) a casting roll drive capable of counter-rotating the casting rolls to form metal shells on casting surfaces of the casting rolls and cast solidified thin steel strip through the nip between the casting rolls from said metal shells;

d) a plurality of preheating chambers removed from an operating position for casting capable of preheating at least a portion of at least one refractory component to be used as a replacement selected from the group consisting of a second core nozzle and a second tundish to a temperature to avoid thermal shock when contacted by molten steel while casting continues;

e) a gate capable of interrupting the flow of molten metal to the casting pool, and capable of resuming flow of molten steel to reform the casting pool;

f) a first transfer device capable of rapidly removing from an operating position at least portions of at least one component selected from the group consisting of at least a portion of the first core nozzle and the first tundish desired to be replaced while leaving the first side dams in the operating position; and g) a second transfer device capable of rapidly transferring at least portions of at least one preheated component selected from the group consisting of the second core nozzle and the second tundish for replacement from the preheating chamber to the operating position for casting while leaving the first side dams in the operating position.

23. The apparatus of claim 22 wherein at least one of the preheated portion of the second core nozzle and second tundish is preheated to a temperature near the temperature of molten steel in the casting pool.

24. The apparatus of claim 22 wherein the second transfer device is capable of rapidly transferring at least a portion of said preheated second core nozzle and second tundish from the preheating position and installing as a replacement in the operating position for casting within about 15 minutes.

25. The apparatus of claim 22 wherein the second transfer device is capable of rapidly transferring at least the preheated portion of said second core nozzle and second tundish from the preheating position and installing as a replacement in the operating position for casting within about 5 minutes.

26. The apparatus of claim 22 further comprising a sensor capable of monitoring the wear of at least a portion of the first core nozzle and the first tundish.

27. The apparatus of claim 26 wherein the sensor comprises an optical sensor.

28. The apparatus of claim 26 wherein the sensor comprises an electrical sensor.

29. The apparatus of claim 26 further comprising in addition a control system responsive to a sensor detecting a given level of wear on at least a portion of the first core nozzle and the first tundish and automatically replacing at least said portions of the first core nozzle and the first tundish with at least replacement portions of a second core nozzle and a second tundish when a given level of wear is detected.

30. The apparatus of claim 22 wherein the preheating of at least a portion of one of the group of the second core nozzle and the second tundish is started at least about 2 hours before transfer to the operating position for casting strip.

31. The apparatus of claim 22 wherein the first transfer device is capable of horizontal translation.

* * * * *